US011136909B2

(12) United States Patent
Taguchi et al.

(10) Patent No.: US 11,136,909 B2
(45) Date of Patent: Oct. 5, 2021

(54) HEAD COVER STRUCTURE

(71) Applicant: HONDA MOTOR CO., LTD., Tokyo (JP)

(72) Inventors: Masayuki Taguchi, Saitama (JP); Kosuke Horisaki, Saitama (JP); Yoshitaka Hara, Saitama (JP); Hiroyuki Kojima, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/109,782

(22) Filed: Dec. 2, 2020

(65) Prior Publication Data

US 2021/0172354 A1 Jun. 10, 2021

(30) Foreign Application Priority Data

Dec. 5, 2019 (JP) ..... JP2019-220627

(51) Int. Cl.
*F01M 13/04* (2006.01)
*F01M 11/08* (2006.01)
(Continued)

(52) U.S. Cl.
CPC ..... *F01M 13/04* (2013.01); *F01M 11/02* (2013.01); *F01M 11/08* (2013.01); *F02F 7/0065* (2013.01); *F01M 2011/023* (2013.01)

(58) Field of Classification Search
CPC ..... F01M 13/04; F01M 11/02; F01M 11/08; F01M 2011/023; F01M 2013/0461; F02F 7/0065
See application file for complete search history.

(56) References Cited

U.S. PATENT DOCUMENTS 8,464,698 B2 * 6/2013 Durkin ..... F02M 35/10321 123/573
2011/0036321 A1 * 2/2011 Lewis ..... F01M 13/02 123/184.22

(Continued)

FOREIGN PATENT DOCUMENTS

JP 2007138823 A 6/2007
JP 2017150418 A 8/2017
JP 2021001572 A 1/2021

OTHER PUBLICATIONS

JPO Office Action for Patent Application JP 2019-220627 dated May 11, 2021; 4 pp.

*Primary Examiner* — Syed O Hasan
(74) *Attorney, Agent, or Firm* — Armstrong Teasdale LLP

(57) ABSTRACT

A head cover structure (45) for an internal combustion engine (1) comprises a head cover (4) connected to a cylinder head (3), and an auxiliary cover (44) connected to the head cover and defining a gas-liquid separation passage (74) jointly with the head cover, the gas-liquid separation passage being communicated with a crankcase chamber (11) of the internal combustion engine, and configured to separate lubricating oil from a crankcase gas drawn from the crankcase chamber, wherein the auxiliary cover is integrally formed with an intake pipe (49) internally defining a part of an intake passage (20) of the internal combustion engine, and the auxiliary cover internally defines a crankcase gas introduction passage (63) communicating the gas-liquid separation passage with an interior of the intake pipe.

7 Claims, 7 Drawing Sheets

(51) Int. Cl.
*F02F 7/00* (2006.01)
*F01M 11/02* (2006.01)

(56) References Cited

U.S. PATENT DOCUMENTS

| | | | | |
|---|---|---|---|---|
| 2014/0245982 | A1* | 9/2014 | Haefner | F02M 35/10222 123/184.21 |
| 2016/0097355 | A1 | 4/2016 | Jentz et al. | |
| 2020/0191029 | A1* | 6/2020 | Kringels | F01M 11/02 |

* cited by examiner

HEAD COVER STRUCTURE

TECHNICAL FIELD

The present invention relates to a head cover structure of an internal combustion engine, and in particular to a head cover structure that defines a part of a passage for returning gas in a crankcase chamber to an intake passage.

BACKGROUND ART

It is widely practiced to recirculate the blow-by gas generated in the crankcase chamber of an internal combustion engine to an intake passage. See US2016/0097355A1, for instance. The internal combustion engine disclosed in this prior patent publication is provided with a vent tube (breather line) connecting the interior of the crankcase (crankcase chamber) with a part of the intake passage located on the upstream side of the throttle valve, and a conduit (PCV line) for connecting the crankcase chamber with a part of the intake passage located on the downstream side of the throttle valve. The breather line is provided with a pressure sensor, and the output of the pressure sensor is forwarded to a control unit for the internal combustion engine.

In particular, the control unit is configured to compute the ratio of the pressure value obtained by the pressure sensor to the integrated value of the predicted pressure value under normal operating condition. The control unit determines that the vent tube has come off from the crank case when the ratio is greater than a prescribed threshold value.

A certain time delay is inevitable for the control unit to obtain the pressure value. The pressure value obtained by the pressure sensor may not be accurate primarily due to the zero offset of the pressure sensor. Therefore, correctly detecting the inadvertent disengagement or removal of a pipe or a tube forming a part of a PCV system without any significant time delay involves a serious difficulty. It is therefore desirable to prevent the occurrence of any inadvertent disengagement or removal of a pipe or a tube in a crank case gas recirculation system that returns gas such as blow-by gas in the crankcase chamber to the intake passage.

SUMMARY OF THE INVENTION

In view of such a problem of the prior art, a primary object of the present invention is to provide a head cover structure of an internal combustion engine internally defining a passage for returning the crankcase gas in the crankcase chamber to the intake passage that can prevent the occurrence of any inadvertent disengagement or removal of a pipe or a tube defining a passage for the crankcase gas with the intake passage.

To achieve such an object, the present invention provides a head cover structure (45) for an internal combustion engine (1), comprising:

a head cover (4) connected to a cylinder head (3); and an auxiliary cover (44) connected to the head cover and defining a gas-liquid separation passage (74) jointly with the head cover, the gas-liquid separation passage being communicated with a crankcase chamber (11) of the internal combustion engine, and configured to separate lubricating oil from a crankcase gas drawn from the crankcase chamber, wherein the auxiliary cover is integrally formed with an intake pipe (49) internally defining a part of an intake passage (20) of the internal combustion engine, and internally defines a crankcase gas introduction passage (63) communicating the gas-liquid separation passage with an interior of the intake pipe.

According to this arrangement, the crankcase gas such as blow-by gas flows from the crankcase chamber into the gas-liquid separation passage, and is introduced into the intake passage defined in the intake pipe. In addition, the intake pipe is integrally formed with the auxiliary cover, and the crankcase gas introduction passage that communicates the gas-liquid separation passage with the interior of the intake pipe is formed inside the auxiliary cover so that the crankcase gas can be circulated back into the intake passage without requiring any component parts that could be disengaged, dislodged or otherwise fail.

Preferably, an oil passage forming portion (48) internally defining an oil supply passage (61) for filling lubricating oil into the crankcase chamber integrally projects from the auxiliary cover (44).

Simply by connecting the auxiliary cover to the head cover, the oil supply passage for filling the lubricating oil into the crankcase chamber can be formed, in addition to the intake pipe and the crankcase gas introduction passage.

Preferably, the intake pipe is located directly above the head cover, and the oil passage forming portion projects upward from the auxiliary cover, a wall part of the intake pipe defining the intake passage being connected to a wall part of the oil passage forming portion defining the oil supply passage.

Since the intake pipe and the auxiliary cover are integrally connected to each other as a one-piece component, the number of parts can be reduced. Further, since the intake pipe is provided directly above the head cover preferably substantially within the outer profile of the auxiliary cover in plan view, the fore and aft size and/or the lateral size of the internal combustion engine can be reduced as compared with the case where the intake pipe is provided in a side part of the head cover so as to protrude from the outer profile of the auxiliary cover in plan view. Further, the rigidity of the auxiliary cover can be increased by integrally forming the intake pipe and the oil supply passage forming portion therewith.

Preferably, the intake pipe is connected to a side of a free end part of the oil passage forming portion in a skewed relationship.

Thereby, connecting a pipe or a hose to the intake pipe is facilitated.

Preferably, the auxiliary cover extends in a cylinder row direction, and includes an upstream forming portion (52) defining an upstream part (64A) of the gas-liquid separation passage in cooperation with the head cover, and a downstream forming portion (53) defining a downstream part (68A) of the gas-liquid separation passage in cooperation with the upstream forming portion. A part of the head cover corresponding to one end part of the upstream forming portion is provided with a main body side communication hole (45A) communicating the upstream part of the gas-liquid separation passage with the crankcase chamber, and another end part of the upstream forming portion is provided with an auxiliary cover side communication hole (58) communicating the upstream part of the gas-liquid separation passage with the downstream part of the gas-liquid separation passage. And, one end part of the downstream forming portion is provided with a wall body (62) connected to the oil supply passage forming portion (48) and the intake pipe, and the downstream part of the gas-liquid separation passage communicates with an interior of the intake pipe via the crankcase gas introduction passage (63) formed in the wall body.

Thus, the crankcase gas travels through the upstream part jointly defined by the upstream forming portion and the head cover, and doubles back the downstream part jointly defined by the upstream forming portion and the downstream forming portion before reaching the interior of the intake pipe. Therefore, as compared with the case where the crankcase gas reaches the interior of the intake pipe only through the upstream part or only through the downstream part, the path length through which the crankcase gas travels before reaching the interior of the intake pipe is increased. As a result, lubricating oil can be favorably separated from the crankcase gas. Furthermore, owing to the presence of the wall body, the rigidity of the auxiliary cover can be increased.

Preferably, the cylinder head is provided with an oil hole (37) for conducting lubricating oil into the crankcase chamber, and the auxiliary cover is provided with a through hole (55) communicating the oil supply passage with the oil hole. And, the through hole is defined by a wall surface curving away from a central axial line of the oil hole, and the downstream part of the gas-liquid separation passage is provided with a curved portion that curves along the wall surface defining the through hole in plan view.

The oil droplets inside the crankcase gas tend to travel linearly more than the gas due to the greater inertia thereof. Therefore, in the curved passage, the oil droplets in the crankcase gas are more likely to adhere to the wall surface defining the flow path and are hence more easily separated than in a linear passage. Thus, the lubricating oil can be effectively separated from the crankcase gas by providing the curved portion in the gas-liquid separation passage.

Preferably, the downstream part of the gas-liquid separation passage has a substantially smaller cross sectional area than the upstream part of the gas-liquid separation passage.

The flow velocity of the crankcase gas in the gas-liquid separation passage is higher in the downstream part than in the upstream part so that the oil droplets in the crankcase gas are more likely to adhere to the wall surface of the curved portion, and the lubricating oil can be more effectively separated from the crankcase gas.

Preferably, a part (45) of the head cover opposing the upstream forming portion is recessed toward the crankcase chamber.

Thereby, the upstream part of the gas-liquid separation passage can be made to have a larger cross sectional area than the downstream part of the gas-liquid separation passage with ease and without increasing the outer dimensions of the internal combustion engine.

Preferably, the upstream part of the gas-liquid separation passage occupies a substantially entire width of the upstream forming portion substantially along an entire length thereof, and the downstream part of the gas-liquid separation passage includes a downstream passage main part (65) extending linearly along a lengthwise direction of the upstream forming part, and connected to an upstream end of the curved portion via a path at an angle to the downstream passage main part.

Thereby, the substantially entire part of the upstream forming portion can be utilized for the upstream part of the gas-liquid separation passage. Since the flow direction of the crankcase gas is sharply changed at the junction between the downstream passage main part and the curved portion, the oil mist can be favorably separated at the junction.

The present invention provides a head cover structure of an internal combustion engine internally defining a passage for returning the crankcase gas in the crankcase chamber to the intake passage that can prevent the occurrence of any inadvertent disengagement or removal of a pipe or a tube defining a passage for the crankcase gas with the intake passage.

BRIEF DESCRIPTION OF THE DRAWING(S)

DESCRIPTION OF THE PREFERRED EMBODIMENT

An automotive internal combustion engine according to an embodiment of the present invention is described in the following with reference to the appended drawings.

Figure 1:
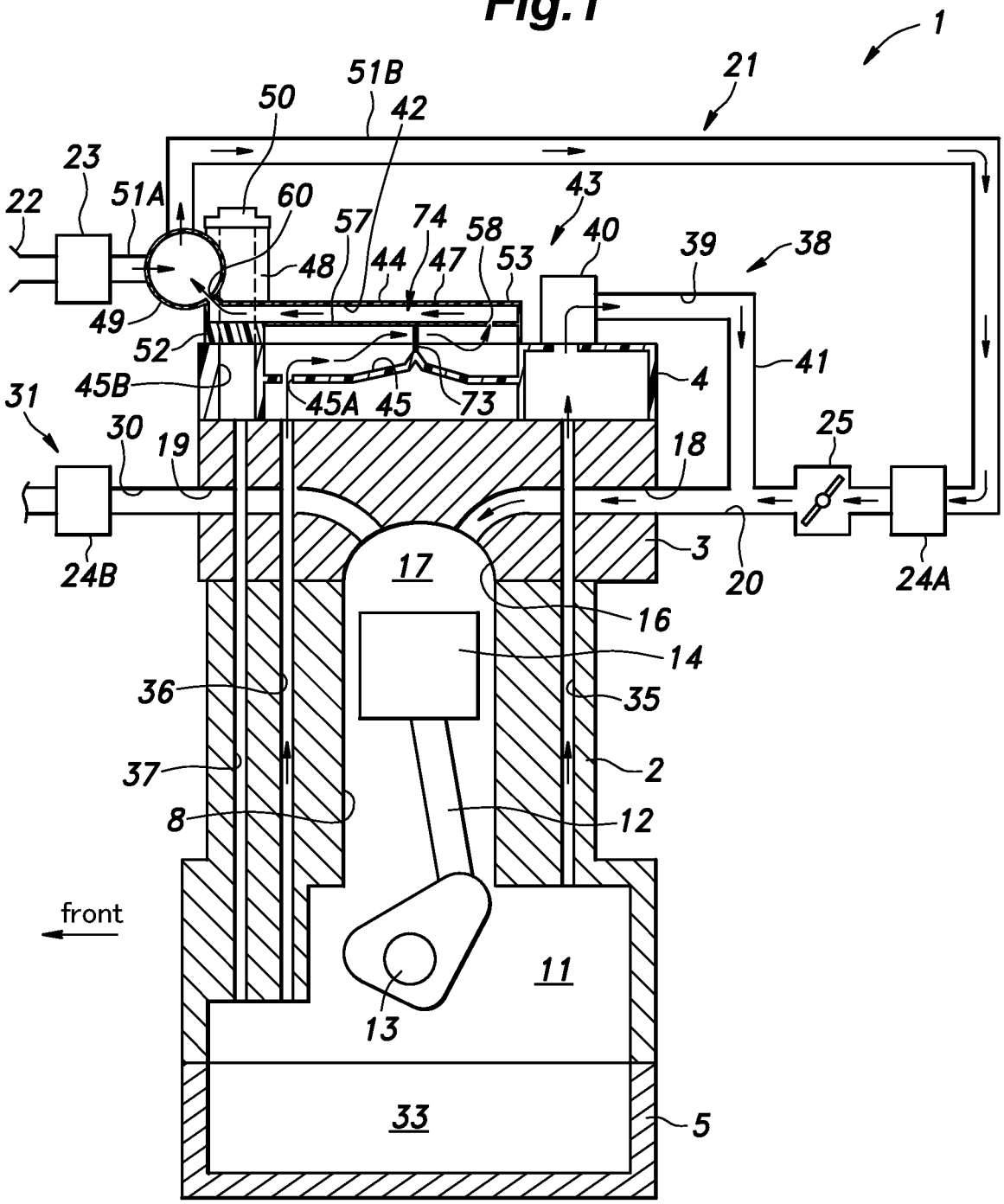
FIG. 1 is a schematic diagram of an internal combustion engine according to an embodiment of the present invention.

The internal combustion engine 1 of the present embodiment is an in-line 4-cylinder reciprocating engine. As shown in FIG. 1, the internal combustion engine 1 includes a cylinder block 2, a cylinder head 3 attached to the upper end of the cylinder block 2, a head cover 4 attached to the upper end of the cylinder head 3 to jointly define a cam chamber, and an oil pan 5 attached to a lower end of the cylinder block 2 to define a crankcase chamber 11.

The cylinder block 2 is formed with four cylinders 8. The cylinders 8 have cylinder axial lines that are arranged on one hypothetical plane in a single row in mutually parallel relationship. The direction along which the cylinders 8 are arranged is called the cylinder row direction. In the present embodiment, the internal combustion engine 1 is mounted on an automobile with the cylinder row direction coinciding with the lateral direction of the vehicle, and the cylinder axial lines slightly tilted rearward. In the following, for the convenience of description, the cylinder axial line direction may be referred to as the vertical direction, and the direction orthogonal to the cylinder axial line and coinciding with the normal traveling direction of the automobile may be referred to as front or rear (fore and aft direction). Further, the cylinder row direction may be referred to as the lateral direction (right-left direction).

The upper end of each cylinder 8 opens at the upper surface of the cylinder block 2, and the lower end thereof communicates with the crankcase chamber 11 defined in the lower part of the cylinder block 2. Each cylinder 8 slidably receives a piston 14 which is connected to a crankshaft 13 via a connecting rod 12. The axial line of the crankshaft 13 extends in the lateral direction.

The cylinder head 3 extends in the cylinder row direction, or in the lateral direction, and is formed with combustion chamber recesses 16 so as to correspond to the respective cylinders 8 on the lower surface thereof. Each combustion chamber recess 16 defines a combustion chamber 17 jointly with the corresponding cylinder 8. The cylinder head 3 is formed with intake ports 18 extending from the respective combustion chamber recesses 16 to the rear side surface of the cylinder head 3, and exhaust ports 19 extending from the respective combustion chamber recesses 16 to the front side surface of the cylinder head 3.

The internal combustion engine 1 is provided with an intake system 21 defining an intake passage 20 which is in turn provided with an air inlet 22, an air cleaner 23, a turbocharger compressor 24A, a throttle valve 25, and an intake manifold in this order from the upstream side. The intake manifold is connected to the cylinder head 3, and communicates the intake passage 20 with the intake ports 18. The internal combustion engine 1 is additionally provided with an exhaust system 31 defining an exhaust passage 30 of the internal combustion engine 1. The exhaust passage 30 includes an exhaust manifold and a turbocharger turbine 24B, as well as a catalytic converter, a muffler, and an exhaust outlet not shown in the drawings, in this order from the upstream side. The exhaust manifold is connected to the cylinder head 3 and communicates with the exhaust ports 19.

The oil pan 5 is formed in a box shape that opens upward, and is connected to the lower part of the cylinder block 2 to form an oil reservoir 33 that stores engine oil (lubricating oil).

The cylinder block 2 and the cylinder head 3 are each provided with a pair of through holes passed vertically therethrough so as to jointly form a first communication hole 35 and a second communication hole 36 (main body side communication hole) for guiding blow-by gas generated in the crankcase chamber 11 to the outside of the crankcase chamber 11. The first communication hole 35 and the second communication hole 36 thus define passages extending vertically inside the cylinder block 2 and the cylinder head 3 each opening toward the crankcase chamber 11 at the lower end thereof and toward the cam chamber at the upper end thereof.

The cylinder block 2 and the cylinder head 3 are each provided with a through hole that is passed vertically therethrough so as to jointly form a third communication hole 37 (oil hole) for conducting lubricating oil from the cam chamber to the crankcase chamber 11. Similar to the first communication hole 35 and the second communication hole 36, the third communication hole 37 defines a passage extending vertically inside the cylinder block 2 and the cylinder head 3 and opening toward the crankcase chamber 11 at the lower end and toward the cam chamber at the upper end thereof.

The internal combustion engine 1 is provided with a PCV device 38 that returns the blow-by gas (crankcase gas) generated in the crankcase chamber 11 to the intake passage 20 via the first communication hole 35 and the second communication hole 36.

The PCV device 38 is provided with a PCV passage 39 (PCV line) communicating the crankcase chamber 11 with the intake manifold via the first communication hole 35. The intake manifold is a part of the intake passage 20 on the downstream side of the throttle valve 25. The upstream side of the PCV passage 39 is formed by the first communication hole 35. An oil separating device 40 for separating oil droplets from the blow-by gas is provided on the downstream side of the first communication hole 35. In this embodiment, as shown in FIG. 1, the oil separating device 40 is incorporated in the head cover 4. The downstream part of the PCV passage 39 is formed by a blow-by gas discharge pipe 41 that connects the oil separating device 40 with the intake manifold.

The PCV device 38 is further provided with a breather passage 42 (which may also be called a breather line or a fresh air introduction passage) that connects a part of the intake passage 20 upstream of the throttle valve 25, or in particular a part of the intake passage 20 located between the air cleaner 23 and the compressor 24A with the crankcase chamber 11 via the second communication hole 36.

The internal combustion engine 1 is provided with a head cover structure 43 which has the functions to define the breather passage 42 and to separate the lubricating oil from the blow-by gas passing through the breather passage 42. The head cover structure 43 includes an auxiliary cover 44 attached to the upper surface of the head cover 4, in addition to the head cover 4.

The head cover 4 is made of plastic material, and covers the upper surface of the cylinder head 3 to define the cam chamber as mentioned earlier. The upper surface of the head cover 4 is provided with a head recess 45 recessed downward, and elongated in the lateral direction (crank axial line direction). In the present embodiment, the head recess 45 has a substantially rectangular shape extending in the lateral direction in top view (plan view). A longitudinal end of the head recess 45 is provided with a main body side opening 45A communicating the interior of the head recess 45 with the second communication hole 36. In the present embodiment, the main body side opening 45A is located at the right end of the head recess 45.

The head cover 4 is provided with a substantially circular (or elliptic) oil inlet 45B that communicates with the third communication hole 37. The oil inlet 45B is passed vertically through the head cover 4, and is located at the one end (right end) of the head recess 45 or at a certain distance from the corresponding end of the head recess 45. The oil inlet 45B is preferably provided with a per se known filter 45C in order to prevent foreign matter from entering the crankcase chamber 11 (see FIGS. 6A and 6B also).

Figure 2:
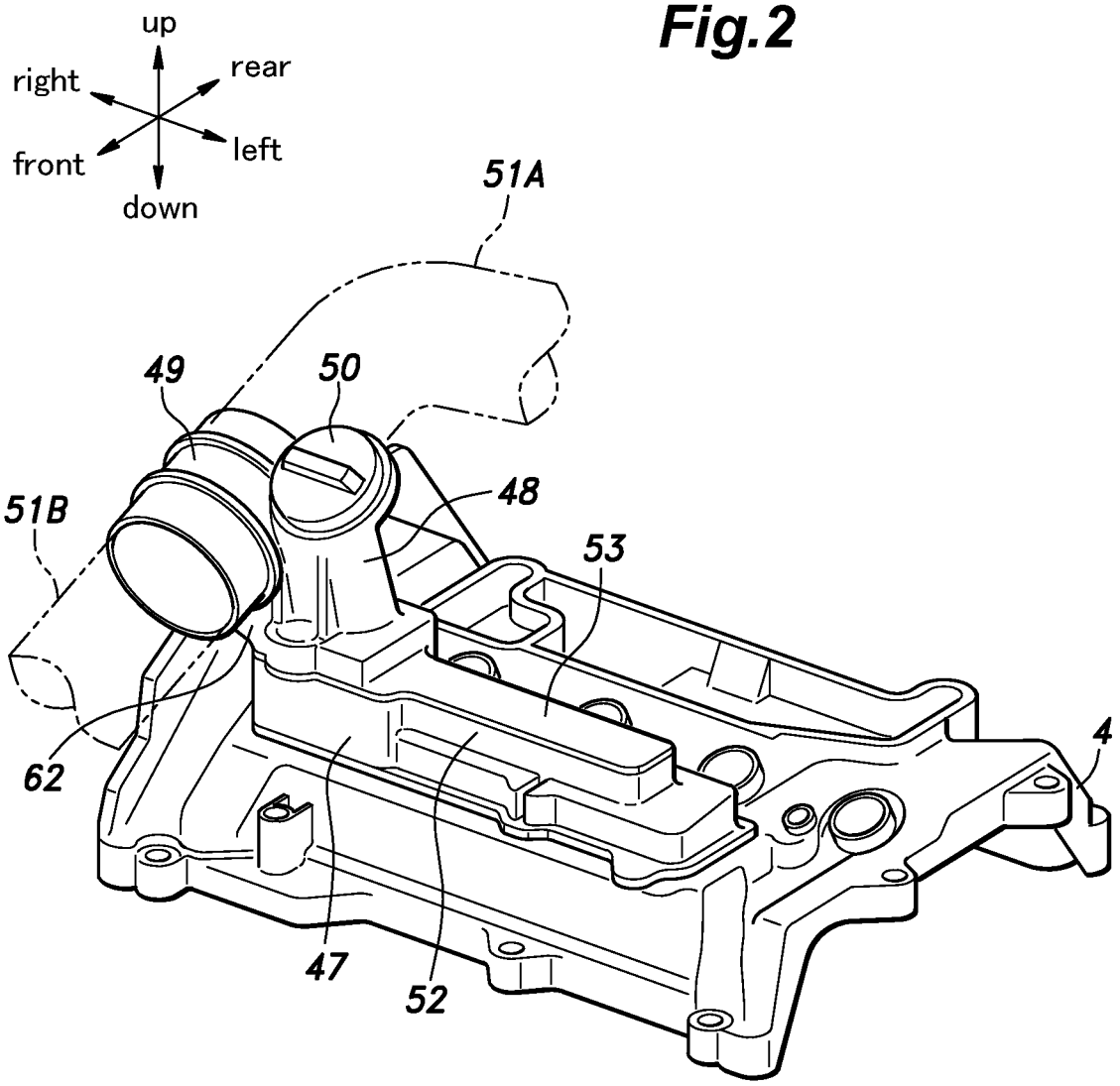
FIG. 2 is a perspective view of a head cover and an auxiliary cover of the internal combustion engine.

As shown in FIG. 2, the auxiliary cover 44 extends in the cylinder row direction (lateral direction), and includes an auxiliary cover main body 47 connected to the upper surface of the head cover 4, a cylindrical tubular portion 48 (oil supply passage portion) projecting upward from the auxiliary cover main body 47, and a tubular intake pipe 49 connected to a free end part of the tubular portion 48. The auxiliary cover main body 47, the tubular portion 48, and the intake pipe 49 are integrally connected to one another so as to form a single-piece component.

Figure 3A:
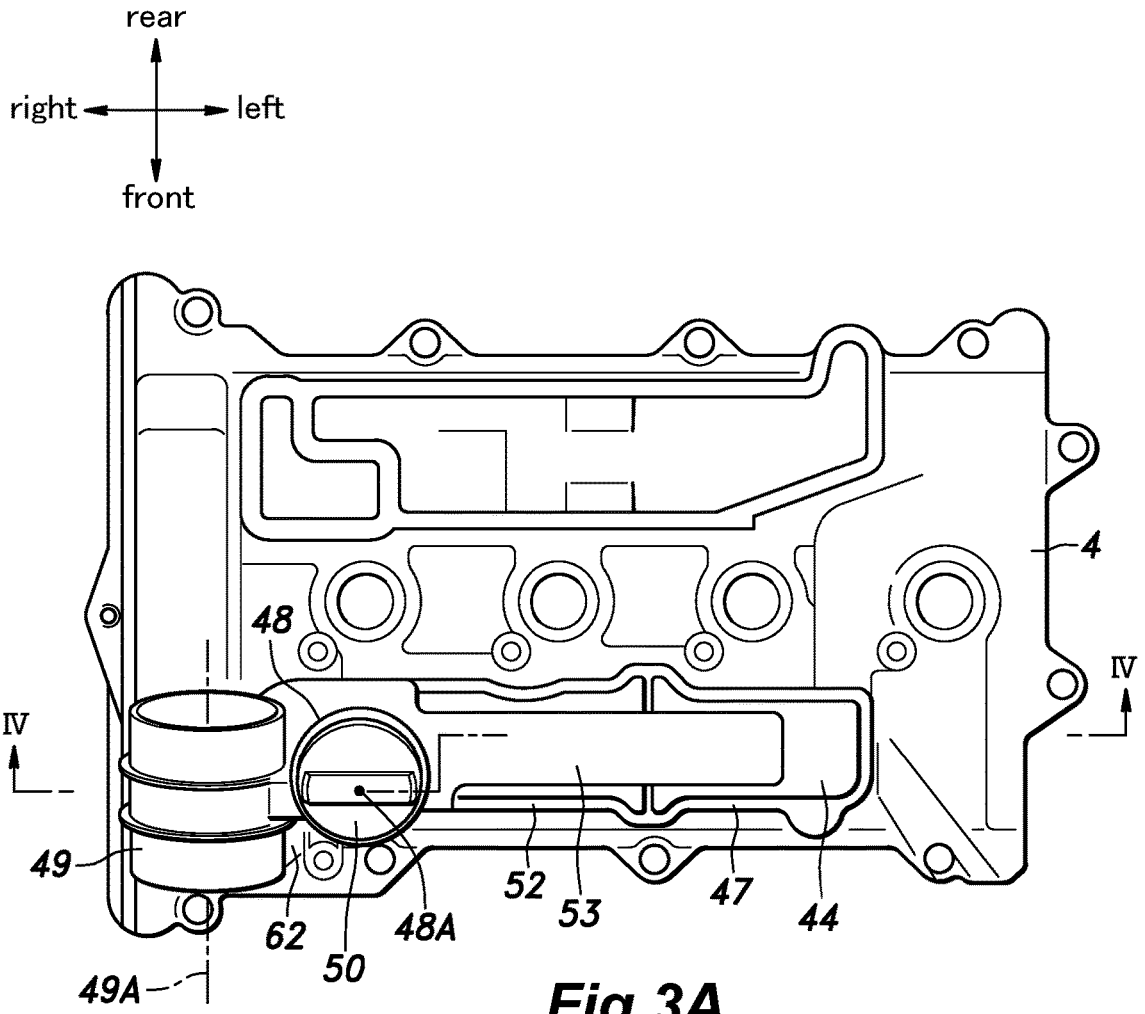
FIG. 3A is a plan view of the head cover and the auxiliary cover.
Figure 3B:
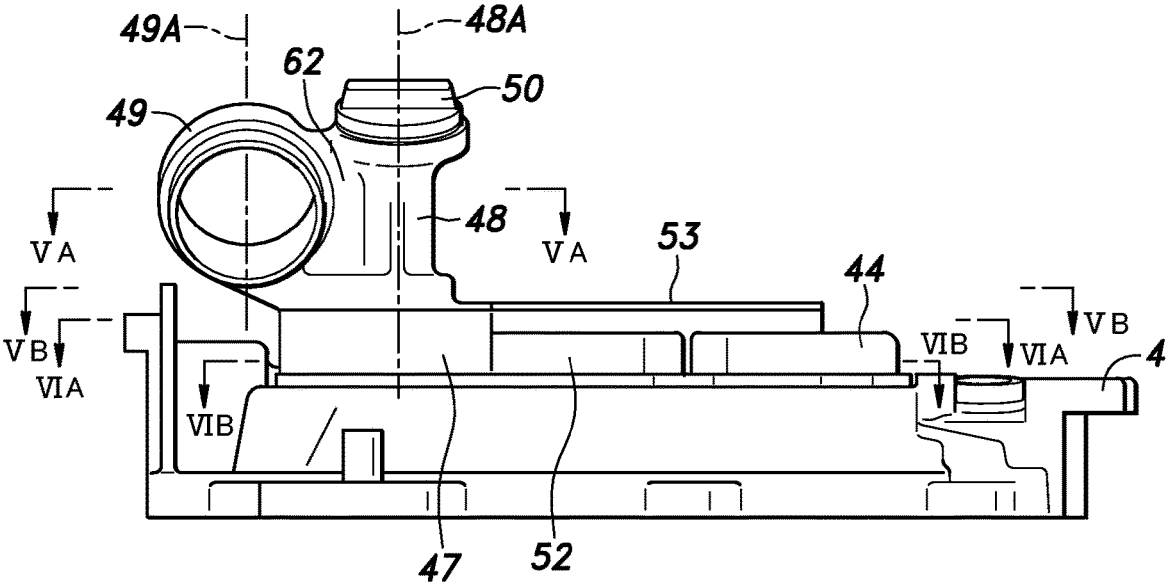
FIG. 3B is a front view of the head cover and the auxiliary cover.

The tubular portion 48 is positioned so as to substantially align with the oil inlet 45B of the head cover 4. The tubular portion 48 is preferably positioned so as to vertically align with or slightly offset from the open end of the third communication hole 37 at the upper surface of the cylinder head 3. As shown in FIGS. 3A and 3B, the tubular portion 48 projects upward from the upper surface of the auxiliary cover main body 47, and has a cylindrical shape centered around a central axial line 48A extending in the vertical direction. The tubular portion 48 opens upward at the upper end thereof. An oil filler cap 50 for closing the upper opening of the third communication hole 37 is provided at the upper end of the tubular portion 48.

The intake pipe 49 has a cylindrical shape centered around a central axial line 49A extending linearly at a slight angle to both the fore and aft direction and the horizontal direction. The intake pipe 49 is integrally formed with the auxiliary cover 44 as mentioned earlier. The intake pipe 49 is connected to a side portion (the right side) of the tubular portion 48 or an outer side portion of the tubular portion 48 with respect to the lengthwise direction of the auxiliary cover main body 47. As shown in FIGS. 2, 3B, 4, and 5A, the axial line 49A of the intake pipe 49 and the axial line 48A of the tubular portion 48 are in a skewed relationship with each other. As shown in FIG. 1, one end of the intake pipe 49 is connected to the air cleaner 23 via a pipe MA, and the other end of the intake pipe 49 is connected to the compressor 24A via another pipe 51B. Thus, the intake pipe 49 defines a part of the intake passage 20 between the air cleaner 23 and the compressor 24A.

The auxiliary cover main body 47 extends in the lateral direction, and has a substantially rectangular box shape. The auxiliary cover main body 47 consists of a main body lower half 52 (upstream forming portion) connected to the upper surface of the head cover 4, and a main body upper half 53 (downstream forming portion) connected to the upper surface of the main body lower half 52.

Figure 4:
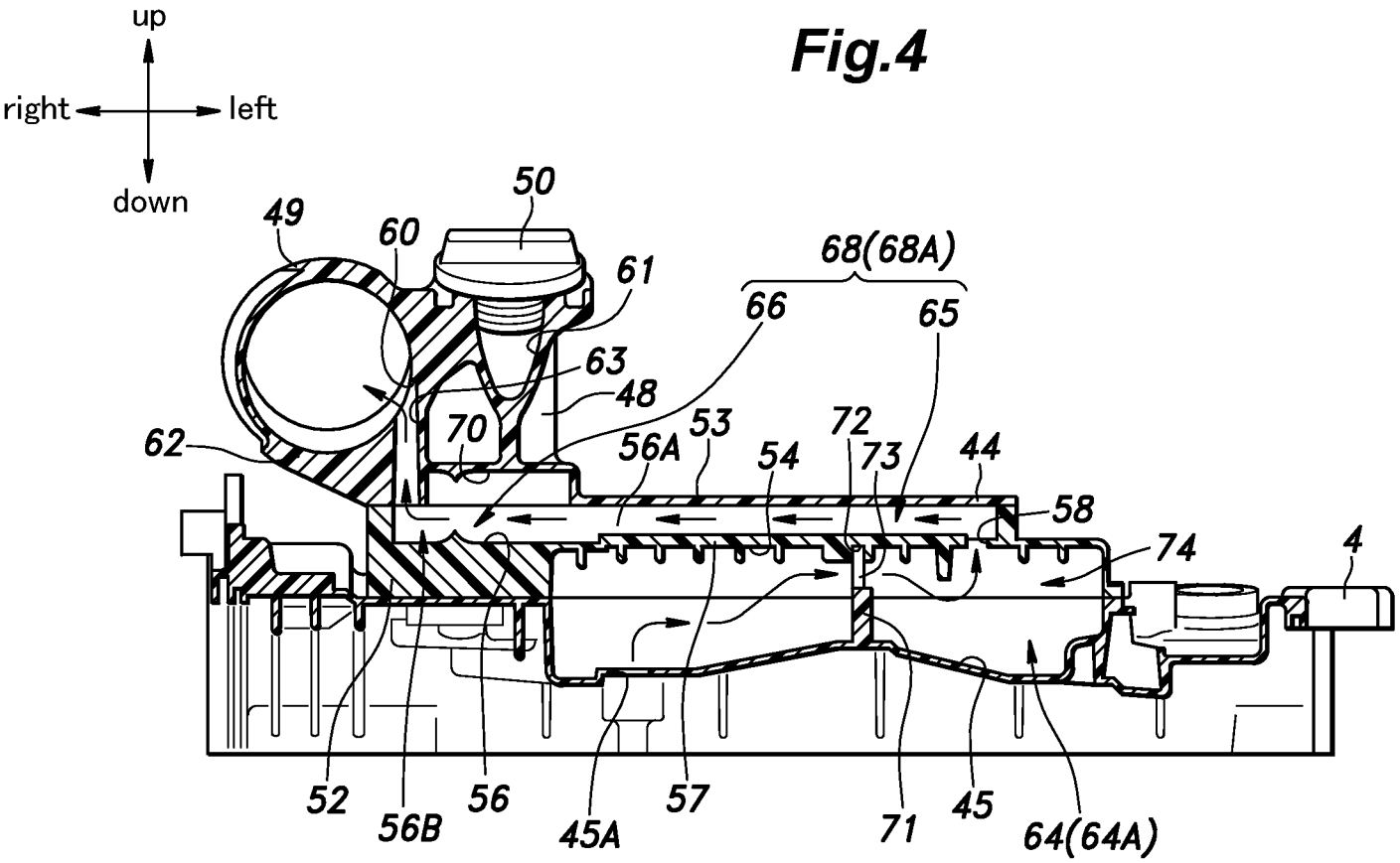
FIG. 4 is a sectional view taken along line IV-IV of FIG. 3A.

As shown in FIG. 4, the main body lower half 52 consists of a laterally elongated plastic member, and is provided with a lower recess 54 recessed upward on a bottom side thereof, a lower through hole 55 (see FIG. 7) passed vertically in a right end part thereof, and an upper recess 56 recessed downward on a top side thereof. The lower recess 54 has a substantially rectangular shape, and extends from a part of the main body lower half 52 displaced by about one-quarter of the entire length of the main body lower half 52 from the right end thereof to the left end thereof. The width (fore and aft dimension) of the lower recess 56 is substantially equal to that of the head recess 45, and occupies the substantially entire width of the main body lower half 52 (minus the wall thickness) as shown in FIG. 6A.

Figure 6A:
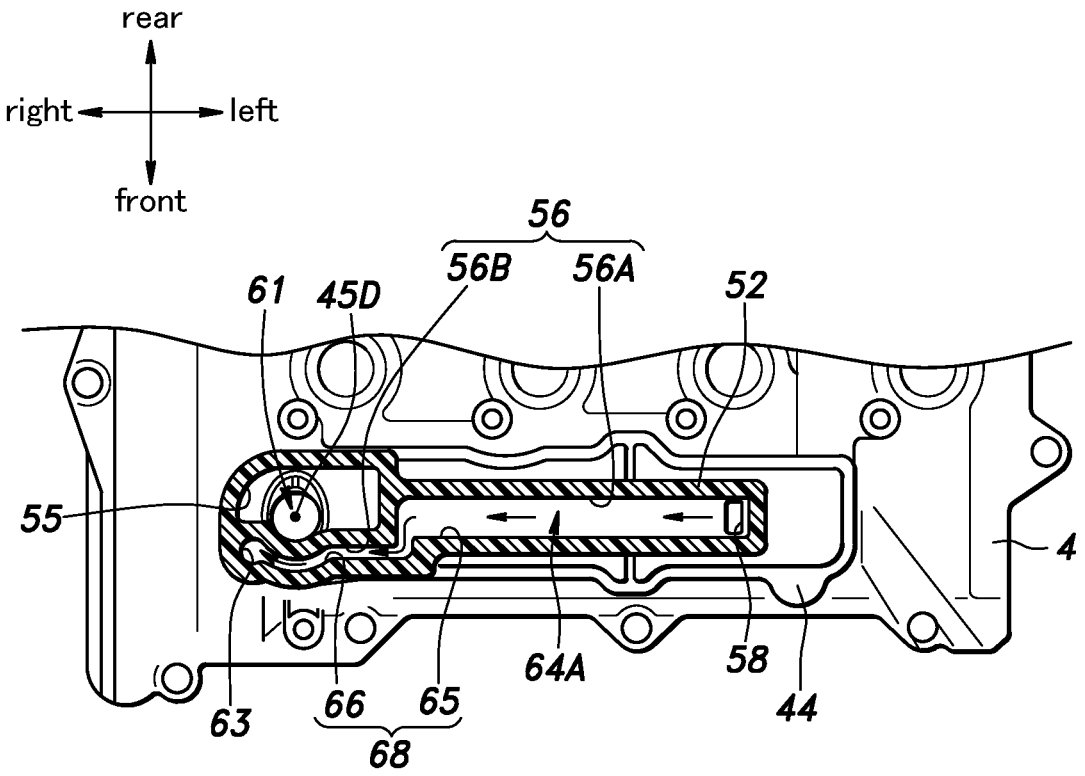
FIG. 6A is a sectional view taken along line VIA-VIA of FIG. 3B.

As shown in FIGS. 4 and 6A, the upper recess 56 is separated from the lower recess 54 by a planar partition wall 57 extending substantially horizontally (or orthogonally to the cylinder axial line). The upper recess 56 includes an upper recess main part 56A extending in the lateral direction in a substantially rectangular shape, and an upper recess extension 56B having a substantially smaller width than the upper recess main part 56A and extending from a front right corner of the upper recess main part 56A to a right end part of the main body lower half 52 in a substantially crank axial line direction (lateral direction). The part of the main body lower half 52 defining the upper recess 56 has a smaller width than the part of the main body lower half 52 defining the lower recess 54, and the upper recess main part 56A occupies the substantially entire width of the main body lower half 52 (minus the wall thickness). A part of the partition wall 57 corresponding to a left end part of the upper recess main part 56A is formed with a lower communication hole 58 (auxiliary cover side communication hole) communicating the upper recess 56 with the lower recess 54. The central axial line of the upper recess main part 56A substantially aligns with the center of the oil inlet 45B.

Figure 7:
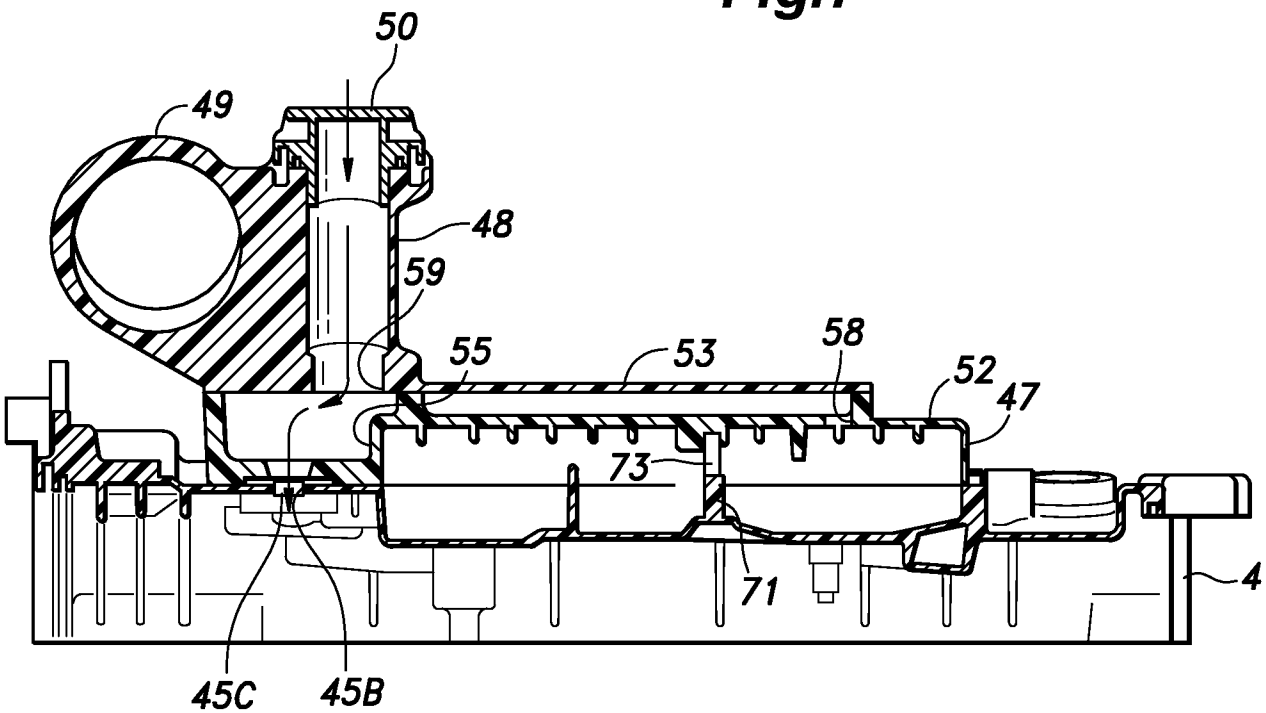
FIG. 7 is a sectional view taken along the axial line of a tubular portion.

As shown in FIGS. 6A and 7, the lower through hole 55 is passed vertically through a right end part of the main body lower half 52. The wall separating the lower through hole 55 from the right end part of the upper recess extension 56B is curved so as to bulge forward, and the outer wall of the main body lower half 52 defining the upper recess extension 56B is curved in a corresponding manner so that the width of the upper recess extension 56B is substantially constant over the entire length (lateral dimension) thereof. The lower through hole 55 is generally provided with a larger diameter than an upper through hole 59 (which will be discussed hereinafter) but is reduced in diameter at the lower end thereof which aligns with the oil inlet 45B.

The main body upper half 53 has a plate shape substantially conformal to the comparatively narrowed upper part of the main body lower half 52 so as to cover and enclose the upper recess 56 from above. More specifically, the main body upper half 53 of the main body covers the upper recess main part 56A, the upper recess extension 56B, and the lower through hole 55 from above. The lower end of the tubular portion 48 is integrally connected to the upper surface of the right end part of the main body upper half 53. The main body upper half 53 is provided with an upper through hole 59 substantially conformal to the inner bore of the tubular portion 48. As a result, as shown in FIG. 7, the interior of the tubular portion 48 communicates with the interior of the lower through hole 55 via the upper through hole 59 substantially without any flow restriction. The interior of the lower through hole 55 thus communicates with the third communication hole 37 via the upper through hole 59, the lower through hole 55, and the oil inlet 45B.

When the operator removes the oil filler cap 50 and pours lubricating oil into the tubular portion 48 from the upper end thereof, the lubricating oil flows into the oil reservoir 33 in the crankcase chamber 11 via the inner bore of the tubular portion 48, the upper through hole 59, the lower through hole 55, the oil inlet 45B, and the third communication hole 37 in this order as indicated by arrows in FIG. 7. As a result, the lubricating oil is supplied to the inside of the crankcase chamber 11. Thus, the tubular portion 48 forms a part of an oil supply passage 61 for introducing lubricating oil into the crankcase chamber 11. In particular, the tubular portion 48 is formed as a part of the auxiliary cover 44, and defines a part of the oil supply passage 61 for introducing lubricating oil into the crankcase chamber 11.

As shown in FIG. 4, a wall body 62 extends upward from the right end of the upper surface of the main body upper half 53 and on the right side of the tubular portion 48. The wall body 62 is connected to the upper surface of the main body upper half 53 at the lower end thereof, and is connected to the right side surface of the tubular portion 48 and the lower surface of the intake pipe 49 at the upper end thereof. In other words, the wall defining a part of the intake passage 20 of the intake pipe 49 and the wall of a part of the tubular portion 48 defining the oil supply passage 61 are connected to each other by the wall body 62. The intake pipe 49 is provided with an intake pipe through hole 60 that is passed therethrough at the junction between the intake pipe 49 and the wall body 62. The main body upper half 53 is further provided with an introduction passage 63 (crankcase gas introduction passage) that communicates with the intake pipe through hole 60 and the upper recess extension 56B by passing through the wall body 62.

Figure 6B:
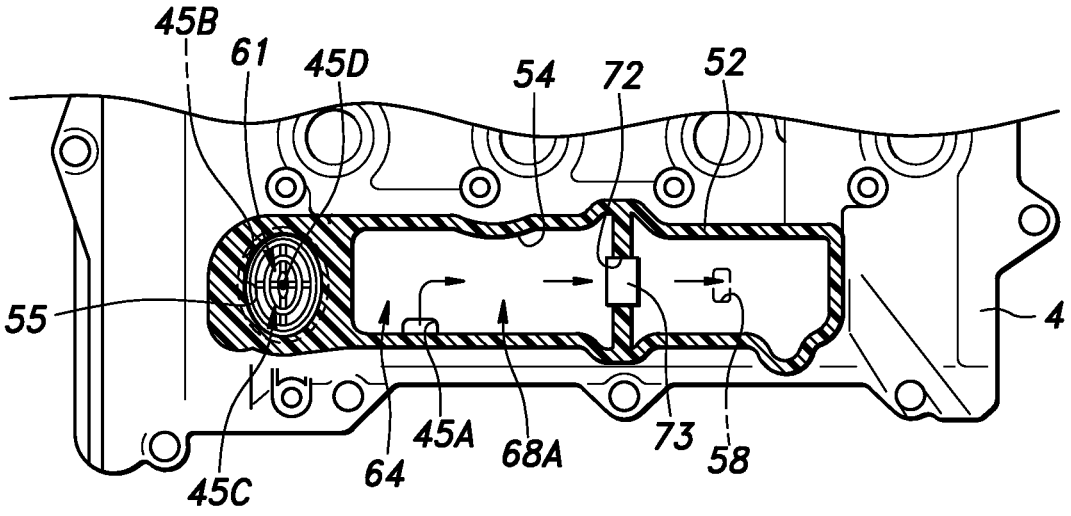
FIG. 6B is a sectional view taken along line VIB-VIB of FIG. 3B.

As shown in FIGS. 4 and 6B, the main body lower half 52 of the auxiliary cover 44 covers the head recess 45, and is attached to the upper surface of the head cover 4. In this conjunction, the intake pipe 49 is located directly above the head cover 4. Further, a lower passage 64 extending in the lateral direction is formed between the main body lower half 52 and the head recess 45. As shown in FIG. 6A, the main body upper half 53 covers the upper recess 56, and the main body upper half 53 and the main body lower half 52 are connected to each other. As a result, an upper passage main part 65 is defined by the wall surface defining the upper recess main part 56A and the lower surface of the main body upper half 53, and an upper passage extension 66 is defined by the wall surface defining the upper recess extension 56B and the lower surface of the main body upper half 53. The upper passage main part 65 and the upper passage extension 66 jointly form an upper passage 68.

Figure 5A:
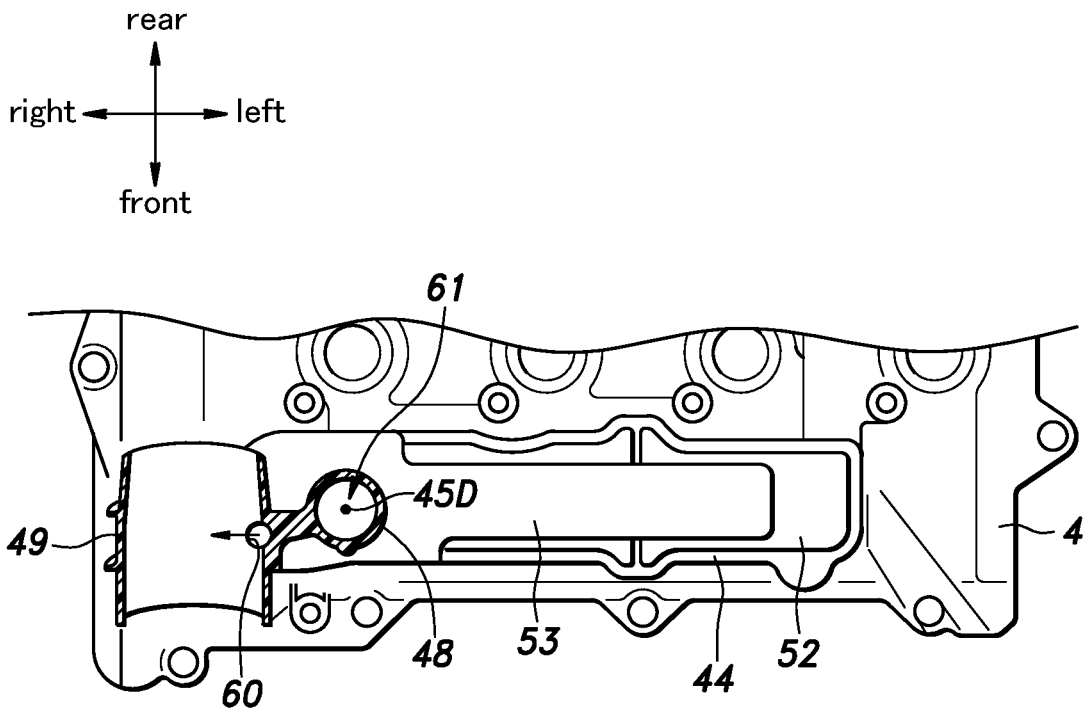
FIG. 5A is a sectional view taken along line VA-VA of FIG. 3B.

The upper passage main part 65 extends along a straight line extending in the crank axial line direction (left-right direction) through the center of the oil inlet 45B in a top view. The cross sectional area of the upper passage main part 65 orthogonal to the crank axial line direction is smaller than the cross sectional area of the lower passage 64 defined by the main body lower half 52 and the head recess 45 orthogonal to the crank axial line direction. More specifically, as shown in FIGS. 5A and 4, the width (fore and aft dimension) of the upper passage main part 65 is smaller than the width (fore and aft dimension) of the lower passage 64 defined by the main body lower half 52 of the main body and the head recess 45. The height (vertical dimension) of the upper passage main part 65 is also smaller than the height (vertical dimension) of the lower passage 64 defined by the main body lower half 52 of the main body and the head recess 45 of the cylinder head 3. The upper passage extension 66 is connected to the right end of the upper passage main part 65, and is curved so as to have a convex side facing forward or away from the central axial line 45D of the oil inlet 45B when viewed from above. Thus, the upper passage extension 66 is defined by a convex rear wall surface and a concave front wall surface, and has a substantially constant width (fore and aft dimension).

The upper passage extension 66 is connected to the introduction passage 63 at the right end thereof. In the present embodiment, an upper recess 70 which is recessed upward is formed in a right end part of the main body upper half 53 or a part of the main body upper half 53 opposing the upper recess extension 56B. In the present embodiment, the upper recess 70 is substantially conformal with the upper recess extension 56B in top view. The upper passage extension 66 is thus jointly defined by the upper recess 70 of the main body upper half 53 and an upper recess extension 56B, and the cross sectional area of the upper passage extension 66 orthogonal to the crank axial line direction (right and left direction) is larger than that of the upper passage main part 65 so that the blow-by gas tends to stagnate in the upper passage extension 66. As a result, separation of oil mist is promoted in the upper passage extension 66.

In the present embodiment, the bottom surface of the head recess 45 is provided with an upright wall 71 projecting toward the part of the main body lower half 52 separating the upper passage main part 65 and the lower passage 64 from each other. The upright wall 71 is located substantially at a mid point of the lower passage 64 along the crank axial line direction, and is provided with a through hole 72 fitted with an impactor 73 for separating oil mist from the blow-by gas.

The flow of blow-by gas in this head cover structure 43 is described in the following.

As indicated by the arrows in FIGS. 1 and 4, the blow-by gas generated in the crankcase chamber 11 flows into the lower passage 64 defined between the main body lower half 52 and the head recess 45 via the second communication hole 36 and the main body side opening 45A. When flowing through the lower passage 64, the blow-by gas passes through the impactor 73. As a result, a part of the oil mist in the blow-by gas is separated by the impactor 73.

As indicated by the arrows in FIGS. 4 and 6B, the blow-by gas that has passed through the impactor 73 travels to the left in the lower passage 64 defined between the main body lower half 52 and the head recess 45, and passes through the lower communication hole 58 formed in the partition wall 57. As indicated by the arrows in FIGS. 4 and 6A, the blow-by gas that has passed through the lower communication hole 58 enters the upper passage main part 65 of the upper passage 68 defined between the upper recess main part 56A and the main body upper half 53, and travels rightward in the upper passage main part 65. The blow-by gas then advances into the upper passage extension 66, and travels rightward in the upper passage extension 66. While the blow-by gas travels through the upper passage extension 66, oil mist contained in the blow-by gas adheres to the wall surface defining the upper recess extension 56B, and is separated from the blow-by gas. In this way, the oil mist in the blow-by gas is separated in the lower passage 64 defined by the main body lower half 52 and the head recess 45, and in the upper passage 68 defined by the main body lower half 52 and the main body upper half 53. Thus, the two passages 64, 68 function as a gas-liquid separation passage 74 that performs gas-liquid separation.

Figure 5B:
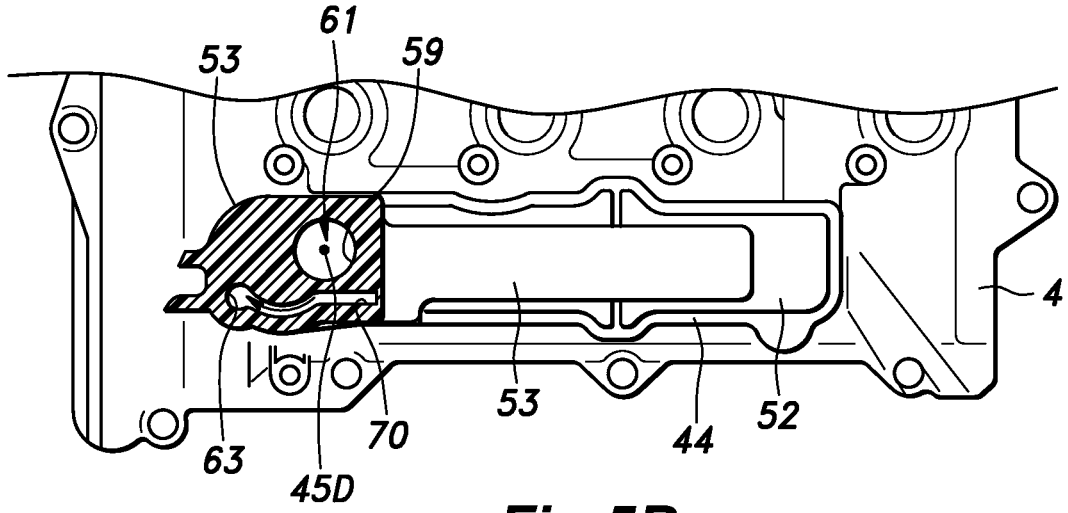
FIG. 5B is a sectional view taken along line VB-VB of FIG. 3B.

The gas-liquid separation passage 74 communicates with the inner bore of the intake pipe 49 via the introduction passage 63 at the right end of the upper passage extension 66. As indicated by the arrows in FIGS. 4, 5A, and 5B, the blow-by gas that has reached the right end of the upper passage extension 66 enters the inner bore of the intake pipe 49 via the introduction passage 63. In this way, the head cover 4 and the auxiliary cover 44 form a breather passage 42 that allows the blow-by gas from the crankcase chamber 11 to be fed into the intake pipe 49. The lower passage 64 formed between the main body lower half 52 and the head recess 45 is located on the upstream side of the upper passage 68 defined between the main body upper half 53 and the main body lower half 52. In other words, the lower passage 64 defined between the main body lower half 52 and the head recess 45 forms the upstream side of the gas-liquid separation passage 74, and the upper passage 68 defined between the main body upper half 53 and the main body lower half 52 forms the downstream side of the gas-liquid separation passage 74. In the following discussion, the lower passage 64 defined between the main body lower half 52 and the head recess 45 may be referred to as an upstream passage 64A, and the upper passage 68 defined between the main body upper half 53 and the main body lower half 52 may be referred to as a downstream passage 68A.

Various features and advantages of this head cover structure 43 are discussed in the following. As shown in FIGS. 1 and 2, the intake pipe 49 is integrally formed with the auxiliary cover 44. As shown in FIG. 4, the introduction passage 63 is formed in the wall body 62 connecting the intake pipe 49 with the auxiliary cover main body 47. Therefore, in the internal combustion engine 1 fitted with this head cover structure 43, the gas-liquid separation passage 74 and the intake pipe 49 can be connected to each other without requiring an external pipe. Thereby, leakage of blow-by gas can be avoided in a reliable manner. As compared to the case where an external tubing defining the introduction passage 63 is connected to the intake pipe 49 via a suitable joint, the introduction passage 63 is prevented from being inadvertently detached from the intake pipe 49 in a more reliable manner. Therefore, disconnection of the intake passage 20 defined inside the intake pipe 49 from the gas-liquid separation passage 74 can be avoided in a reliable manner.

By communicating the inner bore of the intake pipe 49 with the gas-liquid separation passage 74 in the auxiliary cover 44, the length of the introduction passage 63 connecting these two parts can be shortened. By shortening the length of the introduction passage 63, the heat of the internal combustion engine 1 can be efficiently transferred to the entire region of the introduction passage 63. Therefore, moisture or the like contained in the blow-by gas is prevented from freezing inside the introduction passage 63 in a favorable manner.

The blow-by gas reaches the intake pipe 49 by passing through the upstream passage 64A defined by the main body lower half 52 and the head cover 4, and the downstream passage 68A defined by the main body lower half 52 and the main body upper half 53. Therefore, the path length through which the blow-by gas reaches the inner bore of the intake pipe 49 is longer as compared to the case where the blow-by gas reaches the inner bore of the intake pipe 49 only through the upstream passage 64A or only through the downstream passage 68A so that the lubricating oil can be separated all the more effectively from the blow-by gas. By reversing the flow direction of the blow-by gas at the junction between the upstream passage 64A and the downstream passage 68A, the flow path length of the blow-by gas can be maximized for the given length of the auxiliary cover 44.

The cross sectional area of the upstream passage 64A is greater than the cross sectional area of the upper passage main part 65. Therefore, the flow velocity of the blow-by gas is increased in the downstream passage 68A, particularly in the upper passage main part 65. As a result, the oil droplets contained in the blow-by gas are more likely to adhere to the wall surface of the upper passage main part 65 so that the lubricating oil can be more effectively separated from the blow-by gas.

Further, the blow-by gas that has passed through the upper passage main part 65 flows into the upper passage extension 66, and the blow-by gas flows along curved shape of the upper passage extension 66. The oil droplets contained in the blow-by gas tend to travel more linearly than the gas owing to the greater inertia thereof. Therefore, gas-liquid separation can be effectively performed in the upper passage extension 66 as compared with the case where the gas flows in a linear passage. By providing the gas-liquid separation passage 74 with a curved flow path (upper passage extension 66) in this way, the lubricating oil can be effectively separated from the blow-by gas. Further, by curving the wall surface defining the front edge of the lower through hole 55 in a direction away from the axial line 45D of the oil inlet 45B, the lubricating oil can flow into the crankcase chamber through the third communication hole 37 with relatively small resistance.

Further, since the junction between the upper passage main part 65 and the upper passage extension 66 includes a section where the flow direction is bent by about 90 degrees, the flow direction is sharply changed at the junction so that gas-liquid separation of blow-by gas is promoted at the junction.

In the present embodiment, since the head recess 45 is provided in the part of the head cover 4 opposing the main body lower half 52, the cross sectional area of the lower passage 64 jointly defined by the main body lower half 52 and the head recess 45 in a plane orthogonal to the crank axial line direction (the right and left direction) can be maximized without causing any undue upward protrusion of the auxiliary cover 44 from the outer profile of the head cover 4. Also, owing to the presence of the head recess 45, the cross-sectional area of the lower passage 64 in a plane orthogonal to the crank axial line direction can be increased as compared to the cross sectional area of the upper passage main part 65 in a plane orthogonal to the crank axial line direction. Since the upper recess main part 56A is provided substantially over the entire width (fore and aft dimension) of the auxiliary cover 44, the upstream passage 64A can be formed inside the auxiliary cover main body 47 in a space efficient manner.

In the present embodiment, the tubular portion 48 that defines the oil supply passage 61 for introducing the lubricating oil integrally projects from the auxiliary cover 44. As a result, simply by attaching the auxiliary cover 44 to the head cover 4, the oil supply passage 61 for introducing lubricating oil can be formed in addition to the intake pipe 49 and the breather passage 42.

By assembling the auxiliary cover 44 to the head cover 4 in this way, the breather passage 42 can be formed, and further, the intake pipe 49 and the oil supply passage 61 can be provided. Therefore, individual parts for forming the breather passage 42, the intake passage 20 and the oil supply passage 61 are not required to be provided separately so that the number of component parts can be reduced. By positioning the intake pipe 49 above the head cover 4, the intake system 21 can be formed in a compact manner, in particular regarding the direction orthogonal to the cylinder axial line direction of the internal combustion engine 1 (or the right and left direction). Since the auxiliary cover main body 47, the intake pipe 49, and the tubular portion 48 are integrally connected to the wall body 62, the rigidity of the auxiliary cover 44 can be maximized.

Further, since the axial line 48A of the tubular portion 48 and the axial line 49A of the intake pipe 49 are in a skewed relationship to each other (see, FIGS. 3A and 3B, for example), connecting the pipes 51A and 51B to the intake pipe 49 can be simplified as compared to the case where the axial line 48A of the tubular portion 48 is parallel or orthogonal to the intake pipe 49.

The present invention has been described in terms of a specific embodiment, but is not limited in scope by such an embodiment, and can be modified in various ways without departing from the spirit of the present invention. For instance, whereas the head cover structure 43 defined the breather passage 42 in the foregoing embodiment, the head cover structure 43 may also define a PCV passage 39 for introducing PCV gas, which is another crankcase gas, into the intake pipe 49.

The tubular portion 48 had a substantially circular cross section, but may be also have cross section of a rectangular or other polygonal shape, or an elliptic or track shape.

The invention claimed is:

1. A head cover structure for an internal combustion engine, comprising: a head cover connected to a cylinder head; and an auxiliary cover connected to the head cover and defining a gas-liquid separation passage jointly with the head cover, the gas-liquid separation passage being communicated with a crankcase chamber of the internal combustion engine, and configured to separate lubricating oil from a crankcase gas drawn from the crankcase chamber, wherein the auxiliary cover is integrally formed with an intake pipe internally defining a part of an intake passage of the internal combustion engine, and internally defines a crankcase gas introduction passage communicating the gas-liquid separation passage with an interior of the intake pipe; and an oil passage forming portion internally defining an oil supply passage for filling lubricating oil into the crankcase chamber integrally projects from the auxiliary cover; wherein the intake pipe is located directly above the head cover, and the oil passage forming portion projects upward from the auxiliary cover, a wall part of the intake pipe defining the intake passage being connected to a wall part of the oil passage forming portion defining the oil supply passage.

2. The head cover structure according to claim 1, wherein the intake pie pipe is connected to a side of a free end part of the oil passage forming portion in a skewed relationship.

3. The head cover structure according to claim 1, wherein the auxiliary cover extends in a cylinder row direction, and includes an upstream forming portion defining an upstream part of the gas-liquid separation passage in cooperation with the head cover, and a downstream forming portion defining a downstream part of the gas-liquid separation passage in cooperation with the upstream forming portion; wherein a part of the head cover corresponding to one end part of the upstream forming portion is provided with a main body side communication hole communicating the upstream part of the gas-liquid separation passage with the crankcase chamber, and another end part of the upstream forming portion is provided with an auxiliary cover side communication hole communicating the upstream part of the gas-liquid separation passage with the downstream part of the gas-liquid separation passage; and wherein one end part of the downstream forming portion is provided with a wall body connected to the oil supply passage forming portion and the intake pipe, and the downstream part of the gas-liquid separation passage communicates with an interior of the intake pipe via the crankcase gas introduction passage formed in the wall body.

4. The head cover structure according to claim 3, wherein the cylinder head is provided with an oil hole for conducting lubricating oil into the crankcase chamber, and the auxiliary cover is provided with a through hole communicating the oil supply passage with the oil hole; and wherein the through hole is defined by a wall surface curving away from a central axial line of the oil hole, and the downstream part of the gas-liquid separation passage is provided with a curved portion that curves along the wall surface defining the through hole in plan view.

5. The head cover structure according to claim 4, wherein the downstream part of the gas-liquid separation passage has a smaller cross sectional area than the upstream part of the gas-liquid separation passage.

6. The head cover structure according to claim 5, wherein a part of the head cover opposing the upstream forming portion is recessed toward the crankcase chamber.

7. The head cover structure according to claim 4, wherein the upstream part of the gas-liquid separation passage occupies a entire width of the upstream forming portion along an entire length thereof, and the downstream part of the gas-liquid separation passage includes a downstream passage main part extending linearly along a lengthwise direction of the upstream forming part, and connected to an upstream end of the curved portion via a path at an angle to the downstream passage main part.

* * * * *